US010823197B2

(12) United States Patent
Duong et al.

(10) Patent No.: US 10,823,197 B2
(45) Date of Patent: Nov. 3, 2020

(54) VANE DIFFUSER AND METHOD FOR CONTROLLING A COMPRESSOR HAVING SAME

(71) Applicant: PRATT & WHITNEY CANADA CORP., Longueuil (CA)

(72) Inventors: Hien Duong, Mississauga (CA); Vijay Kandasamy, T. Palur (IN); Saurabh S. Nair, Nalanchira (IN)

(73) Assignee: PRATT & WHITNEY CANADA CORP., Longueuil (CA)

( * ) Notice: Subject to any disclaimer, the term of this patent is extended or adjusted under 35 U.S.C. 154(b) by 727 days.

(21) Appl. No.: 15/385,435

(22) Filed: Dec. 20, 2016

(65) Prior Publication Data

US 2018/0172022 A1 Jun. 21, 2018

(51) Int. Cl.
*F04D 29/44* (2006.01)
*F04D 29/68* (2006.01)

(52) U.S. Cl.
CPC ..... *F04D 29/444* (2013.01); *F04D 29/684* (2013.01)

(58) Field of Classification Search
CPC ..... F04D 29/444; F04D 29/684
See application file for complete search history.

(56) References Cited

U.S. PATENT DOCUMENTS 3,964,837 A 6/1976 Exley
3,971,218 A 7/1976 Toth, Jr.
4,054,398 A 10/1977 Penny
4,131,389 A 12/1978 Perrone et al.
4,164,845 A 8/1979 Exley et al.
4,212,585 A 7/1980 Swarden et al.
4,264,271 A 4/1981 Libertini
4,308,718 A 1/1982 Mowill
4,315,714 A 2/1982 Exley et al.
4,368,005 A 1/1983 Exley et al.
4,402,764 A 9/1983 Clark et al.
4,445,816 A 5/1984 Ribaud et al.
4,576,550 A 3/1986 Bryans
4,687,412 A 8/1987 Chamberlain
4,740,138 A 4/1988 Zaehring et al.
(Continued)

FOREIGN PATENT DOCUMENTS

GB 170815 10/1921
GB 775784 A * 5/1957
(Continued)

*Primary Examiner* — Igor Kershteyn
*Assistant Examiner* — Juan G Flores
(74) *Attorney, Agent, or Firm* — Norton Rose Fulbright Canada LLP

(57) ABSTRACT

A vane diffuser for diffusing gases is disclosed. The diffuser has an annular diffuser body including a plurality of diffuser vanes defining diffuser passages. The diffuser passages are circumferentially distributed. A direction of main gas flow through the diffuser passages is defined from a passage inlet in fluid communication with the outlet of the compressor to a passage outlet. A plurality of fluid injection conduits each extend between a conduit inlet and a conduit outlet for at least one of the diffuser vanes. The conduit outlet defines at least one opening in at least one of the pressure and suction side surfaces and is configured to inject fluid along one of the pressure and suction side surfaces in the direction of main gas flow through the corresponding diffuser passage.

17 Claims, 6 Drawing Sheets

(56) References Cited

U.S. PATENT DOCUMENTS

| | | | | |
|---|---|---|---|---|
| 4,832,993 | A | 5/1989 | Coulon | |
| 4,919,773 | A | 4/1990 | Naik | |
| 5,064,691 | A | 11/1991 | Kirner et al. | |
| 5,252,027 | A | 10/1993 | Brasz | |
| 5,372,477 | A | 12/1994 | Cole | |
| 5,385,015 | A * | 1/1995 | Clements | F23R 3/20 60/39.826 |
| 5,427,498 | A | 6/1995 | Lehe et al. | |
| 5,478,200 | A | 12/1995 | Brodersen et al. | |
| 5,564,898 | A | 10/1996 | Richards et al. | |
| 5,601,406 | A | 2/1997 | Chan et al. | |
| 5,618,162 | A | 4/1997 | Chan et al. | |
| 5,876,572 | A | 3/1999 | Rickerby et al. | |
| 6,155,777 | A | 12/2000 | Aschenbruck et al. | |
| 6,166,462 | A | 12/2000 | Finkenbinder et al. | |
| 6,209,312 | B1 | 4/2001 | Singer et al. | |
| 6,210,104 | B1 | 4/2001 | Schoenenborn | |
| 6,220,816 | B1 | 4/2001 | Nguyen Duc et al. | |
| 6,224,321 | B1 | 5/2001 | Ebden et al. | |
| 6,471,475 | B1 | 10/2002 | Sasu et al. | |
| 6,478,887 | B1 | 11/2002 | Sue et al. | |
| 6,589,015 | B1 | 7/2003 | Roberts et al. | |
| 6,605,160 | B2 | 8/2003 | Hoskin | |
| 6,695,579 | B2 | 2/2004 | Meng | |
| 6,706,319 | B2 | 3/2004 | Seth et al. | |
| 6,797,335 | B1 | 9/2004 | Paderov et al. | |
| 7,387,487 | B2 * | 6/2008 | Guemmer | F01D 5/145 415/115 |
| 7,553,122 | B2 | 6/2009 | Kirtley | |
| 8,235,648 | B2 | 8/2012 | Leblanc | |
| 8,641,373 | B2 | 2/2014 | Porodo et al. | |
| 2002/0114693 | A1 | 8/2002 | Bartholoma et al. | |
| 2005/0118019 | A1 | 6/2005 | Roberts et al. | |
| 2015/0226232 | A1 * | 8/2015 | Duong | F04D 17/10 415/1 |

FOREIGN PATENT DOCUMENTS

| | | |
|---|---|---|
| WO | WO-0034628 | 6/2000 |
| WO | WO-0206676 | 1/2002 |

* cited by examiner

VANE DIFFUSER AND METHOD FOR CONTROLLING A COMPRESSOR HAVING SAME

TECHNICAL FIELD

The application relates generally to gas turbine engines and, more particularly, to diffusers for compressors.

BACKGROUND

Stable operation of compressors in gas turbine engines may be limited by two forms of instabilities: rotating stall and surge. Both stall and surge can be detrimental to the performance of the compressor and its operability, and to the structural integrity of the compressor as well. The diffuser of the compressor has been known to contribute to these instabilities. Conventional passage control techniques for improving the stall range in diffuser pipes involves changing the throat size of the diffuser pipes, or performing overboard bleed. However, these solutions can require expensive hardware upgrades, modifications, or engine re-matching.

SUMMARY

There is accordingly provided a vane diffuser for diffusing gases received from an outlet of a compressor, the diffuser comprising: an annular diffuser body including a plurality of diffuser vanes defining therebetween a plurality of diffuser passages, the diffuser passages being circumferentially distributed, each of the diffuser vanes having a pressure side surface and a suction side surface, a direction of main gas flow through the diffuser passages being defined from a passage inlet in fluid communication with the outlet of the compressor to a passage outlet; and a plurality of fluid injection conduits each extending between a conduit inlet and a conduit outlet for at least one of the diffuser vanes, the conduit outlet defining at least one opening in at least one of the pressure and suction side surfaces and configured to inject fluid along said at least one of the pressure and suction side surfaces in the direction of main gas flow through the corresponding diffuser passage.

There is also provided a method for controlling a compressor of a gas turbine engine, the compressor including a compressor rotor which feeds a main gas flow into a diffuser downstream therefrom, the method comprising: directing the main gas flow through a plurality of circumferentially distributed angled diffuser vanes of the diffuser between an inlet and an outlet thereof; and injecting a compressible fluid along a side surface of at least one of the diffuser vanes in a direction of the main gas flow through said diffuser vane.

There is further provided a centrifugal compressor of a gas turbine engine, the centrifugal compressor comprising: an impeller having an inner hub with vanes thereon and adapted to rotate within an outer shroud about a central longitudinal axis, the impeller having a radial impeller outlet; and a diffuser assembly for diffusing gases radially received from the impeller outlet, comprising: an annular diffuser body including a plurality of diffuser vanes defining therebetween a plurality of circumferentially distributed angled diffuser passages, each diffuser vane having a pressure side surface and a suction side surface, a direction of main gas flow through each diffuser passage being defined from a passage inlet in fluid communication with the outlet of the impeller to a passage outlet; and a plurality of fluid injection conduits each extending between a conduit inlet and a conduit outlet for at least one of the diffuser vanes, the conduit outlet defining at least one opening in at least one of the pressure and suction side surfaces and configured to inject fluid along said side surface in the direction of main gas flow through the corresponding diffuser passage.

BRIEF DESCRIPTION OF THE DRAWINGS

Reference is now made to the accompanying figures in which.

DETAILED DESCRIPTION

Figure 1:
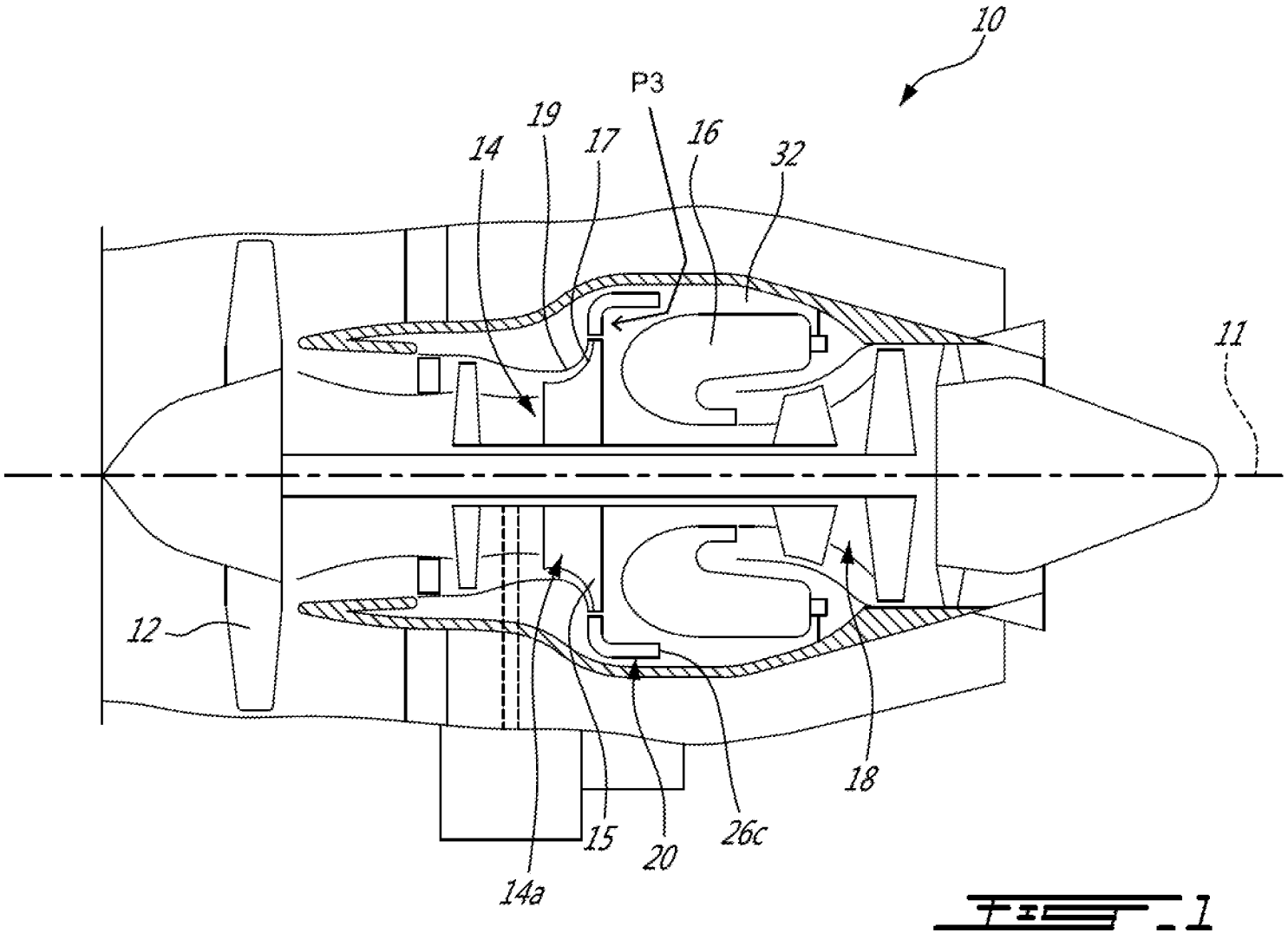
FIG. 1 is a schematic cross-sectional view of a gas turbine engine.

FIG. 1 illustrates a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases. Also shown is a central longitudinal axis 11 of the engine 10.

The compressor section 14 of the engine 10 includes one or more compressor stages, at least one of which includes a centrifugal compressor 14A. The centrifugal compressor 14A includes a rotating impeller 15 with impeller vanes 17 and a downstream diffuser assembly 20. The impeller 15 is configured to rotate within an outer shroud 19 about the central axis 11. The impeller 15 draws air axially, and rotation of the impeller 15 increases the velocity of a main gas flow as the main gas flow is directed though the impeller vanes 17, to flow out in a radially outward direction under centrifugal forces.

The vane diffuser assembly 20 (or simply "diffuser 20") is positioned immediately downstream of the exit of a rotating component of the compressor, which in the exemplary embodiment is the impeller 15. The diffuser 20 forms the fluid connection between the impeller 15 and the combustor 16, thereby allowing the impeller 15 to be in serial flow communication with the combustor 16. The diffuser 20 redirects the radial flow of the main gas flow exiting the impeller 15 to an annular axial flow for presentation to the combustor 16. The diffuser 20 also reduces the velocity and increases the static pressure of the main gas flow when it is directed therethrough.

Figure 2:
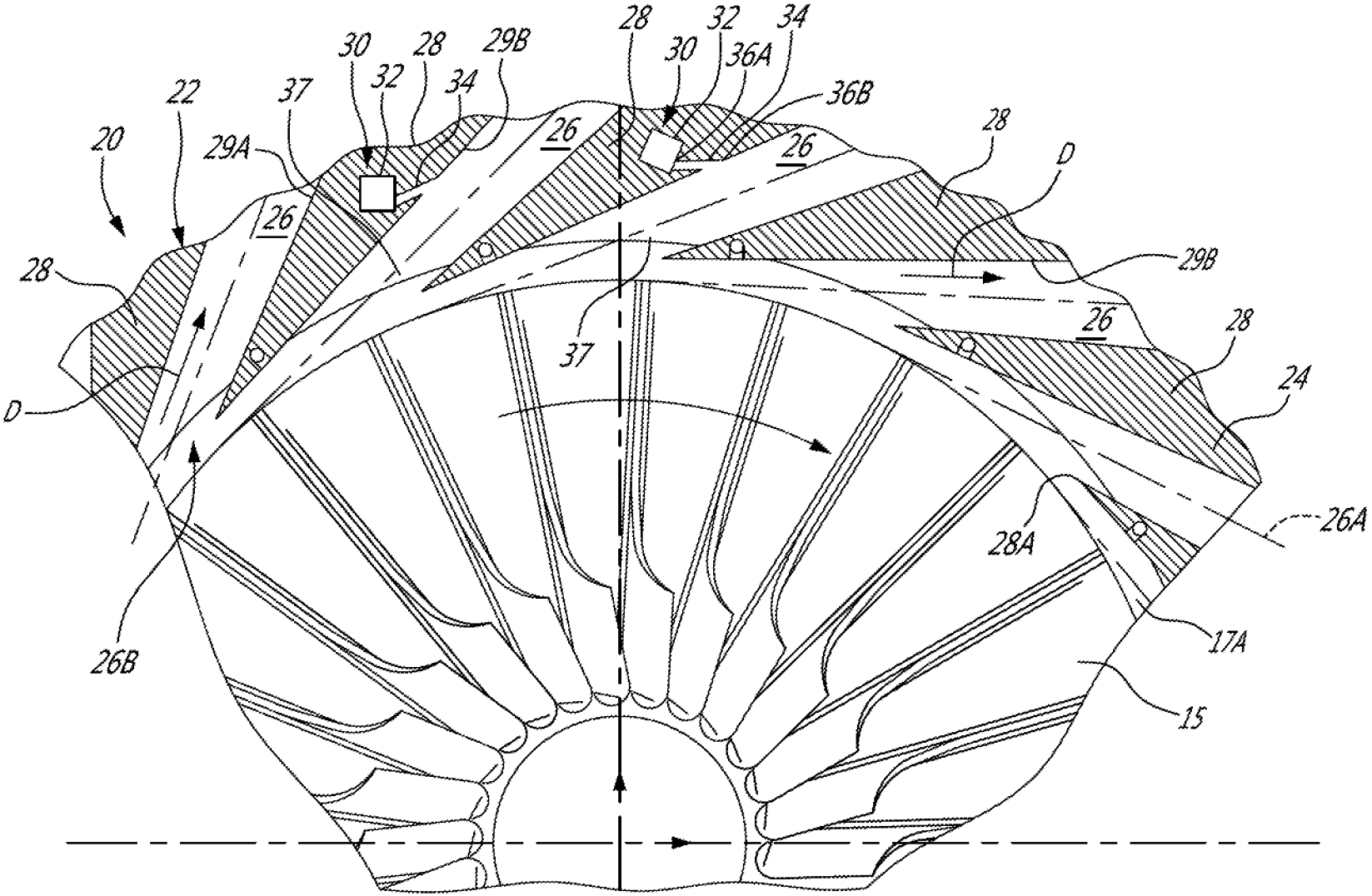
FIG. 2 is a partial cross-sectional view of a portion of a compressor of the gas turbine engine of FIG. 1, viewed in an axial of the gas turbine engine.

Referring to FIG. 2, the diffuser 20 is a vane diffuser and includes an annular diffuser body 22 mounted about the impeller 15. The diffuser body 22 forms the corpus of the diffuser 20 and provides the structural support required to resist the loads generated during operation of the compressor 14A. In most embodiments, the diffuser body 22 is a diffuser ring which can have a vaned, vane-less, or semi-vaned space. The diffuser body 22 is mounted about a circumference of the compressor or impeller outlet 17A so as to receive the main gas flow therefrom.

The diffuser body 22 includes a diffuser case 24 circumscribing and surrounding the impeller outlet 17A. The diffuser case 24 is in one particular embodiment a unitary machined part. A series of angled and circumferentially-distributed diffuser passages 26 extend through the diffuser body 22 from the impeller outlet 17A, each diffuser passage 26 being defined between circumferentially adjacent diffuser islands or stator vanes 28. In the depicted embodiment, each diffuser vane 28 is shaped as a wedge, and includes a pressure side surface 29A and a suction side surface 29B facing the diffuser passages 26. Each diffuser vane 28 forms an airfoil, and has a length extending between a leading edge 28A and a trailing edge 28B, and a height within the diffuser case 24 between a hub 28C and a tip 28D (see FIG. 5).

In the embodiment shown, each diffuser passage 26 is tangential, i.e. it is oriented such that its central axis 26A coincides with a tangent to the periphery of the impeller outlet 17A or to a circle concentric therewith. In the depicted embodiment, the leading edges 28A of the diffuser vanes 28 extend into the space of the impeller outlet 17A. As such, the space of the impeller outlet 17A in FIG. 2 includes a semi-vaneless space. The swirling fluid flow exiting the impeller 15 is aligned in the semi-vaneless space, before entering the diffuser passages 26. Alternate geometries for the diffuser body 22 are also possible, including for example a diffuser with a vaneless inlet space. Irrespective of the chosen geometry, it can be appreciated that the annular diffuser body 22 is positioned to surround a periphery of the impeller 15 for capturing the pressurized main gas flow and directing it radially and outwardly through the diffuser passages 26.

The diffuser passages 26 can be fluid conduits or machined orifices which extend through some, or all, of the diffuser body 22, thus defining fluid paths along which the main gas flow can be conveyed. The diffuser passages 26 each have a passage inlet 26B which is in fluid communication with the impeller outlet 17A so as to receive the main gas flow therefrom, as well as a passage outlet 26C through which the main gas flow exits when it leaves each diffuser passage 26. A direction of main gas flow D is therefore defined through each diffuser passage 26 from its passage inlet 26B to its passage outlet 26C.

Still referring to FIG. 2, the diffuser 20 includes a fluid injection assembly 30. The fluid injection assembly 30 (or simply the "injection assembly 30") is configured to supply a compressible fluid (e.g. air) to one or more of the diffuser vanes 28. It is known that the main gas flow in the diffuser passages 26 can experience an adverse pressure gradient in the direction of main gas flow D. This pressure gradient coupled with existing friction forces in the boundary layer of the side surfaces 29A,29B of the diffuser vanes 28 can aggravate the effect of deceleration experienced by the main gas flow, which may result in the boundary layer being built up within the diffuser passage 26. This buildup leads to increased flow blockage, diminishes pressure recovery, and can eventually lead to flow separation.

By injecting the compressible fluid along one or both of the side surfaces 29A,29B of one or more of the diffuser vanes 28 at a suitable location, it may be possible to prevent and/or reduce increased blockage and flow separation by energizing the boundary layer along the side surfaces 29A, 29B of the diffuser vanes 28. Flow with momentum deficit at the side surfaces 29A,29B is given greater momentum with the addition of the compressible fluid to the main gas flow, making the main gas flow more resistant to flow separation. Another possible benefit may be that the injected compressible fluid helps to keep the main gas flow attached to the side surfaces 29A,29B. The injection assembly 30 has a supply 32 of the compressible fluid, and one or more injection conduits 34 for injecting the compressible fluid along each of the diffuser vanes 28, both of which will now be discussed.

The injection assembly 30 draws the compressible fluid from the supply 32. The supply 32 can be any source of the compressible fluid which is independent of the diffuser 20 and/or the compressor 14A. The compressible fluid from this supply 32 can be actively provided, meaning that it can pumped or otherwise actively directed to the injection conduits 34.

In the depicted embodiment, the supply 32 is simply a region of higher pressure within the compressor 14A or downstream thereof. As shown in FIG. 1, the supply 32 of compressible fluid is the region downstream of the passage outlet 26C and adjacent to an inlet of the combustor 16. This area will generally be filled with so-called "P3" air. Therefore, the compressible fluid injected along the diffuser vanes 28 via the injection conduits 34 is P3 air. In such a configuration, the P3 compressible fluid can recirculate passively toward the injection conduits 34 because the static pressure at the supply 32 is typically greater than the static pressure at the location of the injection conduits 34. Such a passive circulation system can be more easily implemented in existing diffusers. In most embodiments, the compressible fluid is the same as the fluid of the main gas flow. Since P3 compressible fluid is drawn from the combustion chamber of the combustor 16, it can be re-injected at multiple locations within each diffuser passage 26.

Still referring to FIG. 2, each injection conduit 34 is in fluid communication with both the supply 32 and a corresponding diffuser vane 28 so as to inject the compressible fluid along one or more of the side surfaces 29A,29B of the diffuser vane 28 in the direction of main gas flow D. Each injection conduit 34 can be a pipe or duct, or can alternatively be a bore, orifice, or slot through the diffuser vane 28. Each injection conduit 34 extends along its length between a conduit inlet 36A which can receive the compressible fluid from the supply 32, and conduit outlet 36B. In the depicted embodiment, the conduit outlet 36B opens at a point downstream of a throat 37 of the diffuser passage 26. The location of the throat 37 within the diffuser passage 26 can be suitably approximated for a given range of operating conditions of the compressor 14A using fluid dynamic analysis. When the location of the throat 37 is determined using this technique, it is referred to as the "aerodynamic" throat 37. Alternatively, the location of the throat 37 can be approximated to correspond to the location of the smallest cross-sectional area of the diffuser passage 26 in which it is located. By locating the conduit outlet 36B in this position, the compressible fluid exiting the injection conduit 34 may energize the boundary layer of the main gas flow in the diffuser passage 26 so as to reduce or prevent any flow separation. It is believed that such a reduction in flow separation can reduce the mixing losses in the diffuser passage 26, improve the overall efficiency and range of the compressor 14A, and improve the operability of the front stages of the engine 10.

Figure 3:
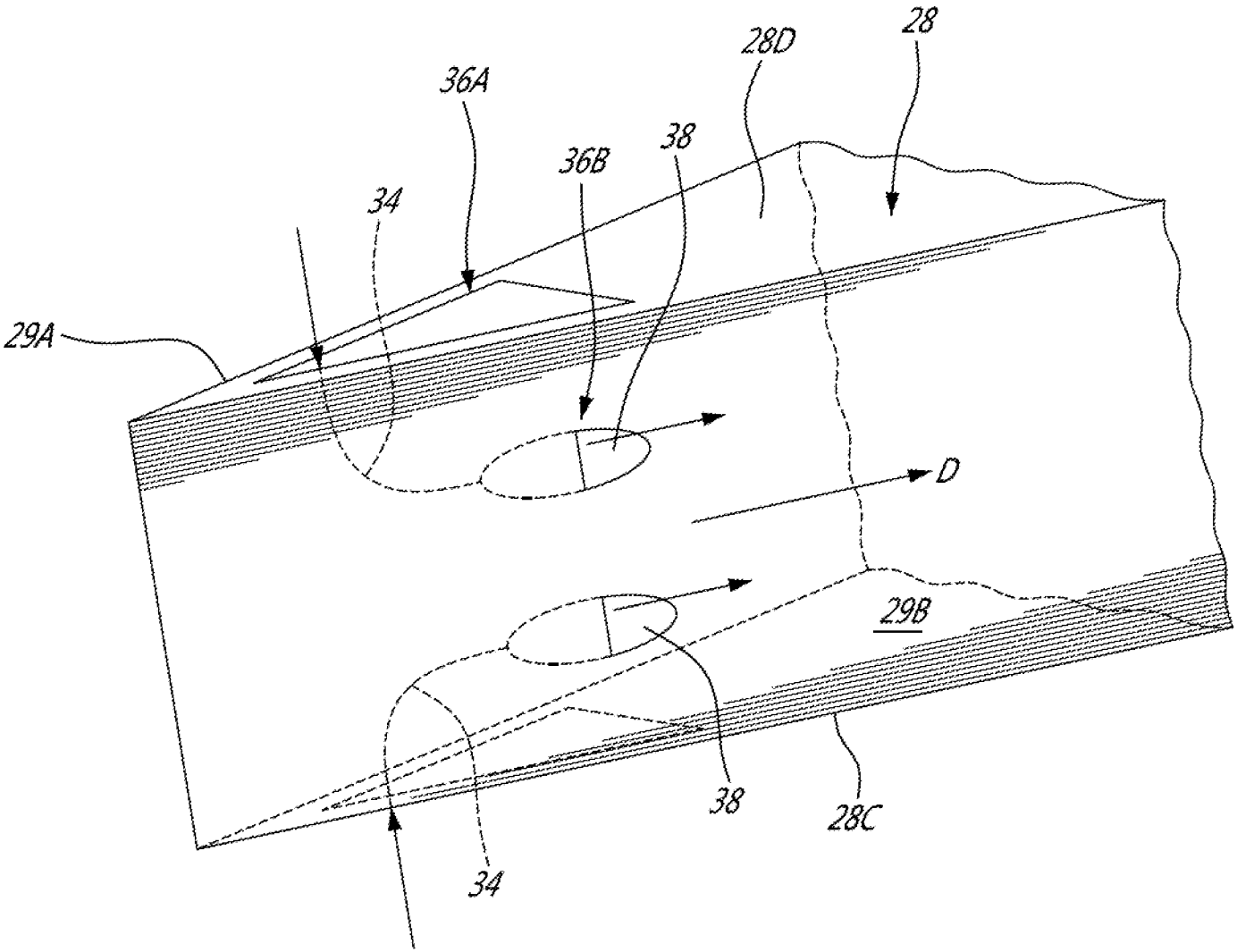
FIG. 3 is a schematic perspective view of a diffuser vane a diffuser of a compressor, such as the one shown in FIG. 2.

Referring to FIG. 3, the conduit outlet 36B of each injection conduit 34 opens into, and is in fluid communication with, a corresponding diffuser vane 28. More particularly, the conduit outlet 36B includes one or more openings 38 in the side surface 29A,29B of the diffuser vane 28. The number of openings 38 on the side surface 29A,29B can vary, such that the injection conduit 34 can inject the compressible fluid into the diffuser passage 26 at multiple locations along the diffuser vane 28.

In the depicted embodiment, each opening 38 is shaped to inject the compressible fluid along the side surface 29A,29B in the direction of main gas flow D and through each diffuser passage 26. It will be therefore appreciated that the shape of each opening 38 can vary to achieve such functionality. In the depicted embodiment, each conduit outlet 36B is defined by an elongated converging duct extending into the body of the diffuser vane 28 and oriented in a downstream direction. The opening 38 of each conduit outlet 36B has an elliptical shape and is formed in the side surface 29A,29B so that fluid exiting therefrom is substantially directed along the side surface 29A,29B in the direction of main gas flow D. The mass flow and velocity of the injected compressible fluid are influenced by the geometry of the conduit outlet 36B and/or its opening 38. The geometry and shape of the conduit outlet 36B and/or its opening 38 may therefore be selected to not only control the amount of compressible fluid, but also to determine the injection angle at which the injected flow is introduced. The injection angle is defined between the vector along which the compressible fluid is injected and the corresponding side surface 29A,29B. In most embodiments, the angle has a value of about zero degrees so that the compressible fluid is injected substantially tangentially to the local vane side surface 29A,28B. In an alternate embodiment, the injection angle is defined between the vector along which the compressible fluid is injected and the vector of the main gas flow D. The angle has a value of about zero degrees so that the compressible fluid is injected substantially parallel to the direction of main gas flow D. It will be appreciated that other configurations for the openings 38 are possible, and are discussed in greater detail below.

Still referring to FIG. 3, the conduit inlet 36A is disposed on a surface of both the hub 28C and the tip 28D of the diffuser vane 28. In alternate embodiments, the conduit inlet 36A is disposed on the surface of only one of the hub 38C and the tipe 28D. The openings defined by the conduit inlet 36A may correspond to openings in the diffuser case 24. Each fluid injection conduit 34 extends into the body of the diffuser vane 28 from the conduit inlet 36A to the conduit outlet 36B on an exposed side surface 29A,29B of the diffuser vane 28. It therefore follows that at least some portion of the diffuser vane 28 is hollow to receive such an injection conduit 34.

It can thus be appreciated that the diffuser 20 disclosed herein allows for injecting higher pressure fluid along the airfoil surfaces 29A,29B of the diffuser vanes 28. This higher pressure air, which in an embodiment is collected in the combustor 16, is therefore re-injected at or near a location where flow reversal occurs on the diffuser vanes 28. By injecting the compressible fluid along the side surfaces 29A,29B of the diffuser vane 28 and in the direction of main gas flow D, it is believed that the boundary layer along the surfaces 29A,29B is energized and additional momentum is provided to the main gas flow through the diffuser passages 26. This contrasts with some conventional techniques for improving diffuser performance, which provide fluid injection along a direction that is normal to the side surface of the diffuser vane. It is believed that injecting relatively low momentum fluid into a diffuser passage in a direction normal to the side surface of the diffuser causes the injected fluid to mix with the higher momentum main gas flow, and causes mixing losses as a result.

Figure 4A:
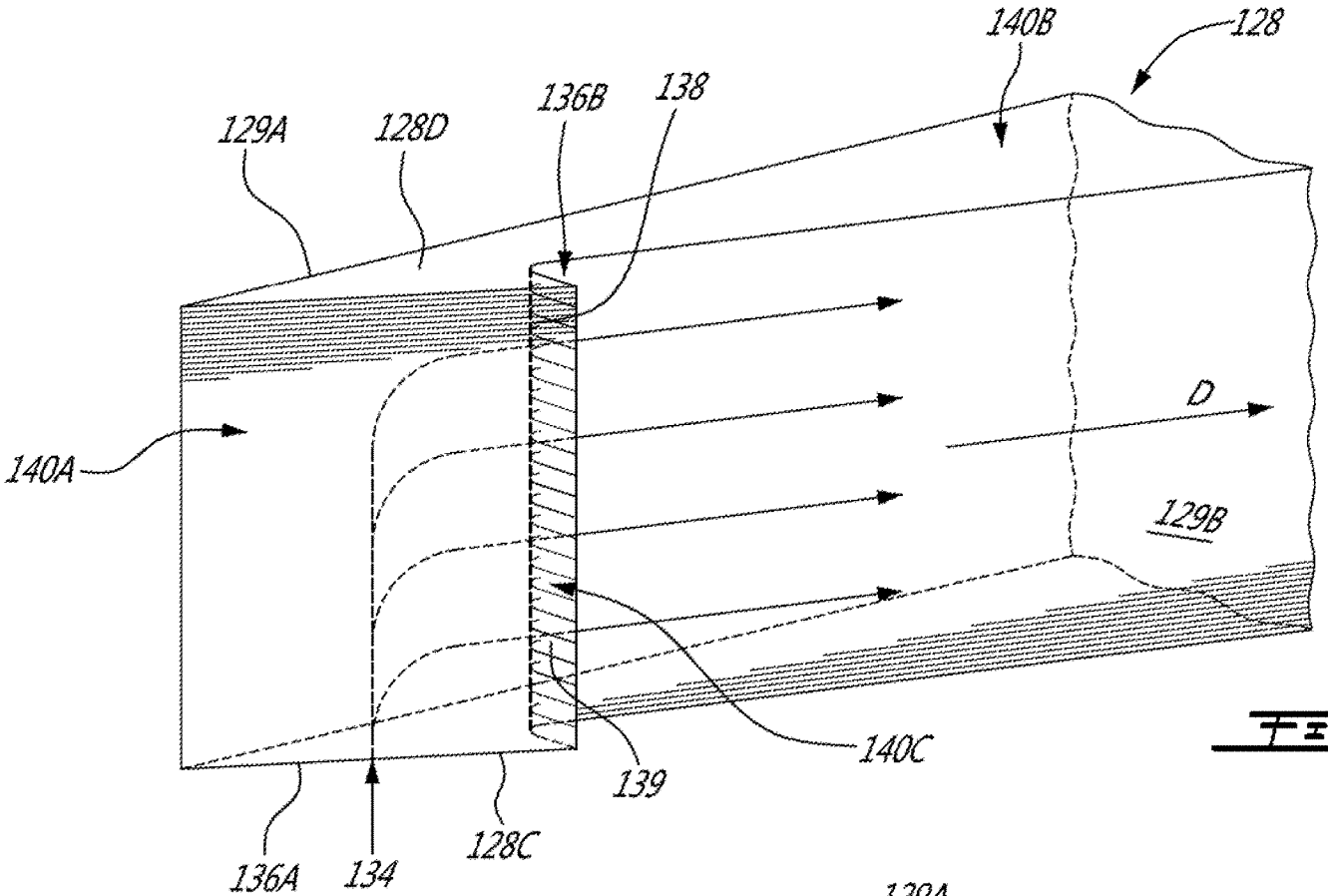
FIG. 4A is a schematic perspective view of another diffuser vane a diffuser of a compressor, such as the one shown in FIG. 2.
Figure 4B:
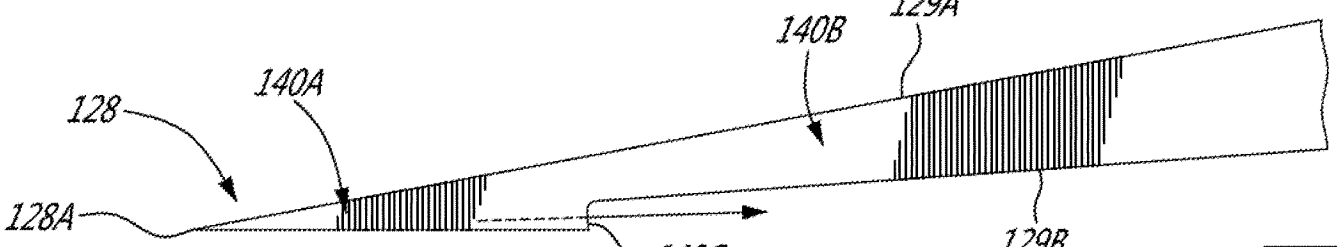
FIG. 4B is an end view of the diffuser vane of FIG. 4A.

FIGS. 4A and 4B show another embodiment of the diffuser vane 128. The orientation of the opening 138 is defined with respect to the direction of main gas flow D through the diffuser passage 26. More particularly, the opening 138 of the conduit outlet 136B lies in an outlet plane 139. The opening of the conduit outlet is a single slot extending along some or all of a length of each diffuser vane 128 between a hub 128C and a tip 128D thereof. The outlet plane 139 is transverse to the direction of main gas flow D. In the depicted embodiment, the outlet plane 139 is substantially perpendicular to the direction of main gas flow D. The direction of main gas flow D is therefore substantially normal to the outlet plane 139. The outlet plane 139 is similarly perpendicular or transverse to the corresponding side surface 129A,129B. This orientation of the opening 138 allows for fluid to be injected along said side surface 129A,129B in the direction of main gas flow D.

The diffuser vane 128 also has a recessed portion along one of the side surfaces 129A,129B. The side surface 129A,129B of the diffuser vane 128 includes a first chordwise segment 140A adjacent to the leading edge 128A of the diffuser vane 128, and a second chordwise segment 140B extending from the first segment 140A to the trailing edge 128B of the diffuser vane 128. The second segment 140B is recessed into the body of the diffuser vane 128 from the first segment 140A to define a notched segment 140C between the first and second segments 140A,140B. In the profile shown in FIG. 4B, the airfoil of the diffuser vane 128 has a cut-out shape along one of its side surfaces 129A,129B. In the depicted embodiment, the notched segment 140C lies in the same outlet plane 139 as the opening 138, and is perpendicular to both the first and seconds segments 140A, 140B. The opening 138 is disposed in the notched segment 140C. Each fluid injection conduit 134 extends between the conduit inlet 136A disposed on the first segment 140A along portion of the hub 128C or tip 128D of the diffuser vane 128, and the conduit outlet 136B disposed along the notched segment 140C.

Figure 4C:
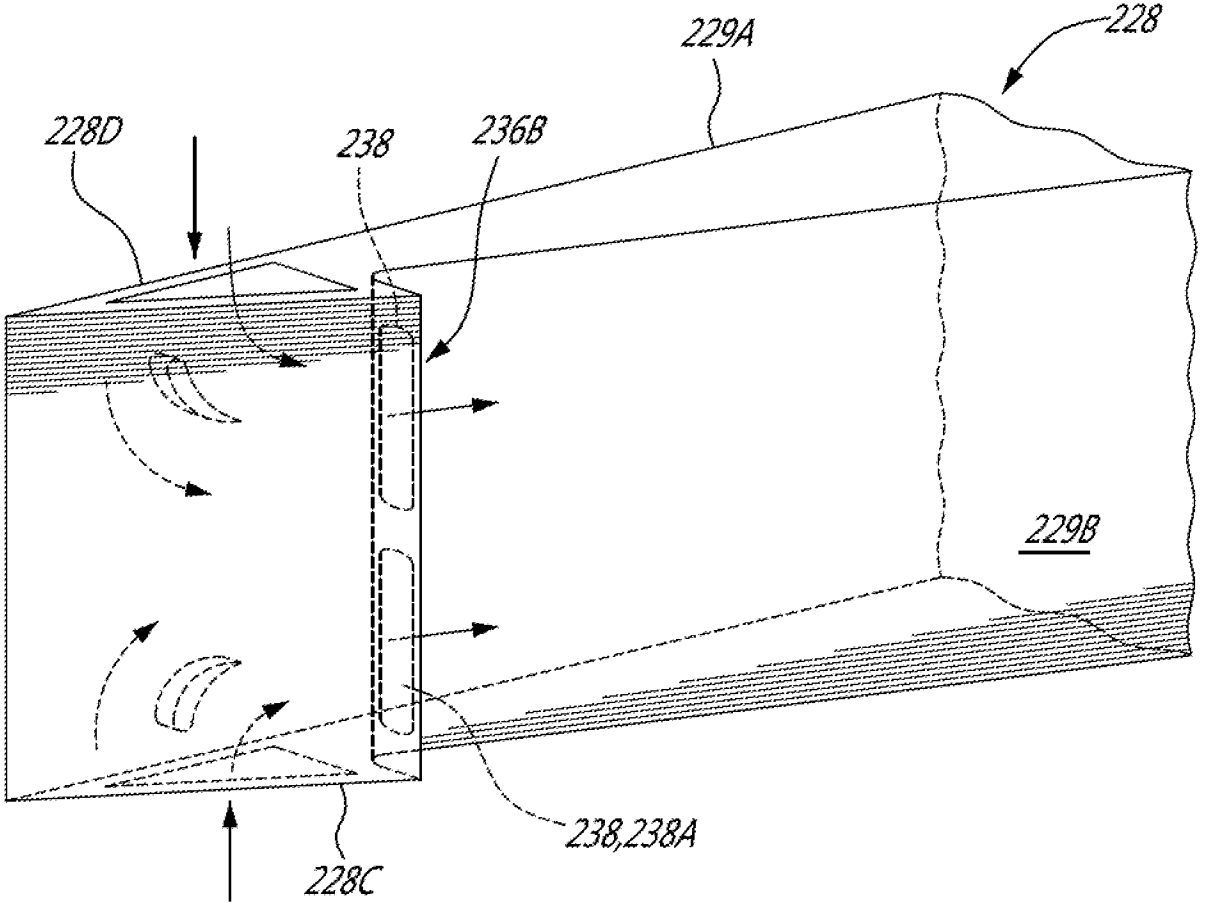
FIG. 4C is a schematic perspective view of yet another diffuser vane a diffuser of a compressor, such as the one shown in FIG. 2.

FIG. 4C shows another embodiment of the diffuser vane 228. The conduit outlet 236B includes two or more openings 238 on one or both of the side surfaces 229A,229B. The openings 238 are spaced apart from one another along a length of the diffuser vane 228 defined between its hub 228C and its tip 228D. One of the openings 238A is disposed in proximity to the hub 228C of the diffuser vane 228. The position of the opening 238A at this location allows for fluid injection near the hub 228C, thereby helping to energize the main gas flow at a location where there is an important amount of flow separation.

Figure 5:
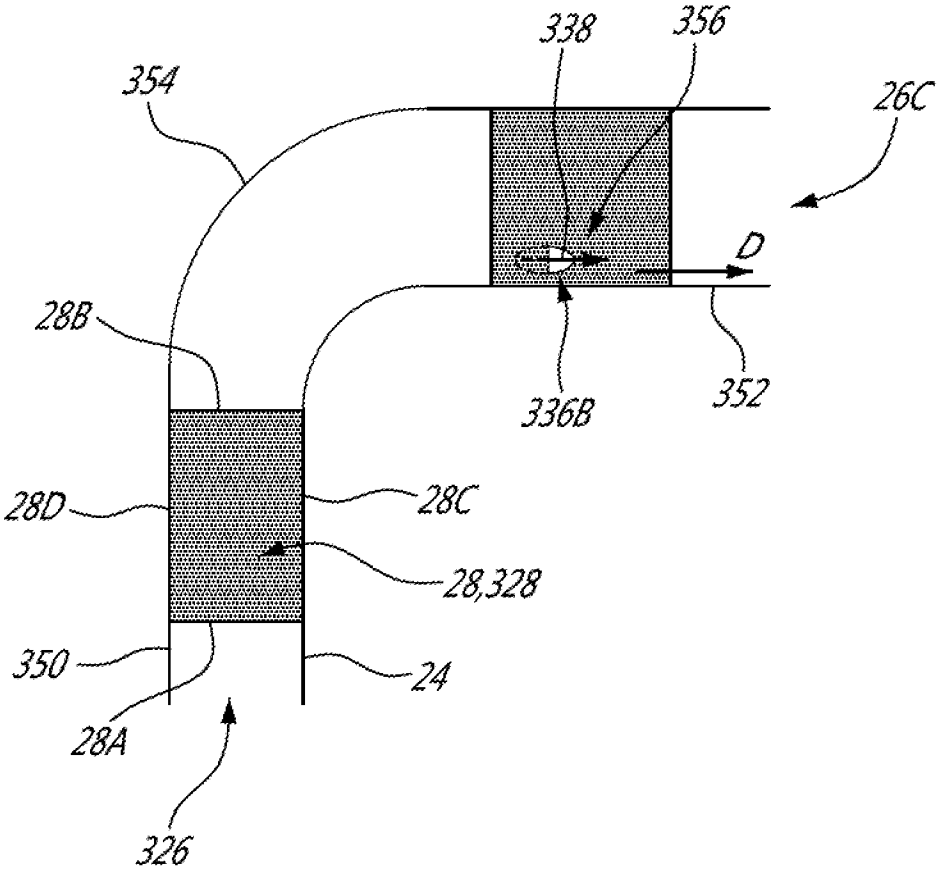
FIG. 5 is a partial schematic view of a diffuser passage of a diffuser of a compressor, viewed in a radial plane of the gas turbine engine.

FIG. 5 shows another embodiment of the diffuser passage 326 of the diffuser 20. The diffuser passage 326 includes a first section 350 beginning at the passage inlet 326B and extending away therefrom. In the embodiment where the compressor section 14 includes an impeller 15, the first section 350 is a radial segment immediately downstream of the impeller 15. The circumferentially spaced-apart diffuser vanes 328 are present in the radial first section 350 and help to define the adjacent diffuser passages 326. The diffuser passage 326 also includes a second section 352 extending substantially parallel to the central axis 11 of the compressor 14A along a second section length terminating at the passage outlet 326C. In an embodiment, the second section 352 includes a pipe added onto the diffuser body 322, and forms an axial segment immediately upstream of the combustor 16. The diffuser passage 326 also includes a curved section 354 in fluid communication with the first and second sections 350,352 and disposed downstream of the first section 350 and upstream of the section 352. The curved section 354 forms a bent segment between the radial and axial segments. One or more turning vanes 356 are disposed in the second section 354 of the diffuser passage 326. The turning vanes 356 help to remove swirl from the main gas flow before it enters the combustor 16.

In the depicted embodiment, compressible fluid is provided to be injected along the surface of the turning vanes 356. Each fluid injection conduit includes a turning vane conduit outlet 336B in fluid communication with the supply of compressible fluid. The turning vane conduit outlet 336B defines one or more openings 338 in one or both of the pressure and a suction side surface of each turning vane 356. The openings 338 are shaped to inject fluid along the corresponding side surface in the direction of main gas flow D through each diffuser passage 326.

Referring to FIG. 2, a method for controlling a compressor is also disclosed. The main gas flow is directed along direction D through the diffuser vanes 28 of the diffuser 20. Compressible fluid is injected along a side surface 29A,29B of each diffuser vane 28 in a direction of the main gas flow D through each diffuser vane 28.

In light of the preceding, it can be appreciated that the diffuser 20 disclosed herein allows for re-circulated fluid to re-energize the boundary layer along the side surfaces 29A, 29B of the diffuser vanes 28. The injected fluid helps to reduce diffuser range flow separation and can lead to improvements in diffuser range and pressure recovery. The reduction in diffuser losses may help to improve the overall performance and range of the compressor 14A. In at least some embodiments, the flow injection is performed passively and is driven only by the pressure difference between areas downstream of the diffuser and the point of flow injection. Such a passive control technique is relatively easy and cheap to implement. This contrasts with some conventional techniques for improving diffuser stator stall range (e.g. bores in the diffuser, leading edge tip corner cutback, overboard bleed, etc.).

The above description is meant to be exemplary only, and one skilled in the art will recognize that changes may be made to the embodiments described without departing from the scope of the invention disclosed. For example, although the diffuser is described herein as being a component of a centrifugal compressor, it will be appreciated that the diffuser can also be used with an axial compressor. Still other modifications which fall within the scope of the present invention will be apparent to those skilled in the art, in light of a review of this disclosure, and such modifications are intended to fall within the appended claims.

The invention claimed is:

1. A vane diffuser for diffusing gases received from an outlet of a compressor, the diffuser comprising:

an annular diffuser body including a plurality of diffuser vanes defining therebetween a plurality of diffuser passages, the plurality of diffuser passages being circumferentially distributed, each of the diffuser vanes having a pressure side surface and a suction side surface, a direction of main gas flow through the plurality of diffuser passages being defined from a passage inlet in fluid communication with the outlet of the compressor to a passage outlet; and a plurality of fluid injection conduits each extending between a conduit inlet and a conduit outlet for at least one of the diffuser vanes, the conduit outlet defining at least one opening in at least one of the pressure and suction side surfaces, the at least one opening lying in an outlet plane being perpendicular to the direction of main gas flow and configured to inject fluid along said at least one of the pressure and suction side surfaces in the direction of main gas flow through the corresponding diffuser passage.

2. The vane diffuser as defined in claim 1, wherein at least one of the pressure and suction side surfaces of the at least one diffuser vane includes a first segment adjacent a leading edge of the at least one diffuser vane, and a second segment extending from the first segment to a trailing edge of the at least one diffuser vane, the second segment being recessed from the first segment to define a notched segment therebetween, the at least one opening being disposed in the notched segment.

3. The vane diffuser as defined in claim 2, wherein each fluid injection conduit extends between the conduit inlet disposed on the first segment of the at least one diffuser vane along a hub or a tip thereof, and the conduit outlet being disposed along the notched segment of the at least one diffuser vane.

4. The vane diffuser as defined in claim 1, wherein the at least one opening of the conduit outlet is a single slot extending a length of the at least one diffuser vane between a hub and a tip thereof.

5. The vane diffuser as defined in claim 1, wherein the conduit outlet defines at least two openings on the at least one of the pressure and suction side surfaces, the openings being spaced apart along a length of the at least one diffuser vane defined between a hub and a tip thereof.

6. The vane diffuser as defined in claim 1, wherein each diffuser passage has a throat therein, the at least one opening of the plurality of fluid injection conduits being shaped to inject fluid along the at least one of the pressure and suction side surfaces downstream of the throat.

7. The vane diffuser as defined in claim 1, wherein a supply of fluid is disposed downstream of the passage outlets in a region of the compressor having P3 air, the P3 air having a static pressure greater than a static pressure at the conduit inlets of the plurality of fluid injection conduits, the P3 air circulating passively from the supply to the conduit inlets of the plurality of fluid injection conduits.

8. The vane diffuser as defined in claim 1, wherein the at least one opening of the conduit outlet is in the suction side surface of the at least one diffuser vane.

9. The vane diffuser as defined in claim 1, wherein each diffuser passage includes a first section beginning at the passage inlet and extending away therefrom, a second section extending substantially parallel to a central axis of the compressor along a second section length terminating at the passage outlet, and a curved section in fluid communication with the first and second sections and disposed downstream of the first section and upstream of the second section, at least one turning vane being disposed in the second section of each diffuser passage.

10. The vane diffuser as defined in claim 9, comprising a turning vane conduit outlet in fluid communication with a supply of fluid, the turning vane conduit outlet defining at least one opening in at least one of a pressure and a suction side surface of each turning vane, the at least one opening being shaped to inject fluid along the at least one of the pressure and the suction side surface in the direction of main gas flow through each diffuser passage.

11. A method for controlling a compressor of a gas turbine engine, the compressor including a compressor rotor which feeds a main gas flow into a diffuser downstream therefrom, the method comprising:

directing the main gas flow through a plurality of circumferentially distributed angled diffuser vanes of the diffuser between an inlet and an outlet thereof; and injecting a compressible fluid through an opening in a side surface of at least one of the plurality of circumferentially distributed angled diffuser vanes in a direction of the main gas flow through the at least one of the plurality of circumferentially distributed angled diffuser vanes, the opening lying in an outlet plane being perpendicular to the direction of main gas flow.

12. The method as defined in claim 11, wherein injecting the compressible fluid further comprises drawing the compressible fluid from a supply of P3 air downstream of the diffuser.

13. The method as defined in claim 11, wherein injecting the compressible fluid comprises circulating P3 air passively from a supply thereof to each of the plurality of circumferentially distributed angled diffuser vanes.

14. The method as defined in claim 11, wherein injecting the compressible fluid includes injecting the compressible fluid into the main gas flow at a location downstream of a throat of the at least one of the plurality of circumferentially distributed angled diffuser vanes.

15. A centrifugal compressor of a gas turbine engine, the centrifugal compressor comprising:

an impeller having an inner hub with vanes thereon and adapted to rotate within an outer shroud about a central longitudinal axis, the impeller having a radial impeller outlet; and a diffuser assembly for diffusing gases radially received from the radial impeller outlet, comprising:

an annular diffuser body including a plurality of diffuser vanes defining therebetween a plurality of circumferentially distributed angled diffuser passages, each diffuser vane having a pressure side surface and a suction side surface, a direction of main gas flow through each of the circumferentially distributed angled diffuser passages being defined from a passage inlet in fluid communication with the radial impeller outlet to a passage outlet; and a plurality of fluid injection conduits each extending between a conduit inlet and a conduit outlet for at least one of the plurality of diffuser vanes, the conduit outlet defining at least one opening in at least one of the pressure and suction side surfaces, the at least one opening lying in an outlet plane being perpendicular to the direction of main gas flow and configured to inject fluid along the at least one of the pressure and suction side surfaces in the direction of main gas flow through the corresponding diffuser passage.

16. The compressor as defined in claim 15, wherein the at least one of the pressure and suction side surfaces of the at least one diffuser vane includes a first segment adjacent a leading edge of the at least one diffuser vane, and a second segment extending from the first segment to a trailing edge of the at least one diffuser vane, the second segment being recessed from the first segment to define a notched segment therebetween, the at least one opening being disposed in the notched segment.

17. The compressor as defined in claim 16, wherein each fluid injection conduit extends between the conduit inlet disposed on the first segment of each diffuser vane along a hub or a tip thereof, and the conduit outlet being disposed along the notched segment of each diffuser vane.

* * * * *